US009756947B2

(12) United States Patent
Lee

(10) Patent No.: US 9,756,947 B2
(45) Date of Patent: Sep. 12, 2017

(54) ARTICULATING SEATING APPARATUS AND SYSTEM

(71) Applicant: Brian Karl Lee, Iowa City, IA (US)

(72) Inventor: Brian Karl Lee, Iowa City, IA (US)

( * ) Notice: Subject to any disclaimer, the term of this patent is extended or adjusted under 35 U.S.C. 154(b) by 0 days.

(21) Appl. No.: 14/934,293

(22) Filed: Nov. 6, 2015

(65) Prior Publication Data

US 2017/0127841 A1 May 11, 2017

(51) Int. Cl.

| | |
|---|---|
| ***A47C 7/56*** | (2006.01) |
| ***A47C 4/04*** | (2006.01) |
| ***A47C 7/02*** | (2006.01) |

(52) U.S. Cl.

CPC ..... *A47C 7/563* (2013.01); *A47C 4/04* (2013.01); *A47C 7/022* (2013.01); *A47C 7/566* (2013.01)

(58) Field of Classification Search

CPC ..... A47C 4/04; A47C 7/022; A47C 7/563; A47C 7/566

See application file for complete search history.

(56) References Cited

U.S. PATENT DOCUMENTS

| | | | | | |
|---|---|---|---|---|---|
| 4,192,547 | A * | 3/1980 | Geier | A47C 7/02 | 297/271.5 |
| 4,798,414 | A * | 1/1989 | Hughes | A47C 7/462 | 297/284.4 |
| 5,975,641 | A * | 11/1999 | Delesie | A47C 7/024 | 297/284.3 |
| 6,174,585 | B1 * | 1/2001 | Miles | A47B 85/00 | 297/118 |
| 6,293,621 | B1 * | 9/2001 | Marsh | A47C 7/566 | 297/248 |
| 7,387,334 | B2 * | 6/2008 | Phipps | A47C 4/14 | 297/17 |
| 7,887,136 | B2 * | 2/2011 | Zoell | A47C 4/022 | 297/284.3 |
| 2004/0222676 | A1 * | 11/2004 | Okabayashi | A47C 7/024 | 297/29 |
| 2006/0022494 | A1 * | 2/2006 | Sanderson | F16G 13/16 | 297/29 |
| 2015/0054314 | A1 * | 2/2015 | Grace | A47C 7/70 | 297/45 |
| 2015/0320218 | A1 * | 11/2015 | Taylor | A47C 13/00 | 297/16.1 |

* cited by examiner

*Primary Examiner* — Philip Gabler
(74) *Attorney, Agent, or Firm* — McKee, Voorhees & Sease, PLC

(57) ABSTRACT

An improved seating apparatus and system includes an interconnected plurality of articulating assemblies having an upright position and a seated position. Each of the articulating assemblies includes a seat member pivotally connected to a base member, and a back member pivotally connected to the seat member. The articulating assemblies are configured to pivot incrementally relative to one another between the seated position and the upright position. A portion of the articulating assemblies can be in the seated position while another portion can be in the upright position. The result can be a wave-like and/or curvilinear seating surface. The articulating assemblies are configured to automatically return from the seated position to the upright position. The articulating assemblies can be configured to articulate in two directions to provide two seating surfaces positioned on opposite sides of the back member of the seating apparatus.

26 Claims, 16 Drawing Sheets

ARTICULATING SEATING APPARATUS AND SYSTEM

FIELD OF THE DISCLOSURE

The present disclosure relates generally to seating apparatuses and systems. More particularly, but not exclusively, the present disclosure relates to a functional and/or aesthetically-pleasing seating apparatus and system that responds to user involvement.

BACKGROUND OF THE DISCLOSURE

The structures upon which people sit can include chairs, benches, stools, pews, recliners, lounges, and the like. The structures typically share several commonalities. A generally horizontal seating portion is supported by one or more generally vertical legs. A generally vertical back portion is connected to the seating portion in some manner. For example, a chair typically has four vertical legs supporting a horizontal seating member, and a vertical back is attached to the seating member to allow an individual to lean backwardly in the chair with support. For another example, a bench typically has two vertical leg structures positioned opposite a horizontal elongated member surface upon which multiple people can sit. An elongated vertical back is attached to the seating member to allow an individual to lean backwardly in the bench with support.

The seating structures having these characteristics are limited in at least a few respects. In instances where the horizontal seating member is rigidly connected to vertical leg structure(s), the depth of the overall seating structure is constrained to at least the depth of the horizontal seating member. Further, the upper surface of the horizontal seating member remains in an exposed position to spills, inclement weather (outdoor seating), and the like. To that end, folding seats are well known in the art, such as those found in a sporting venue or movie theatre.

For any number of reasons, a bench may be preferable to a series of folding seats. For example, only one individual can sit in each of the series of the folding seats, whereas benches typically provide an individual to select where on the bench to seat oneself. Further, folding seats (and by extension, folding benches) either must manually lifted to the collapsed position by the individual, or a spring-like device is incorporated (e.g., a torsion spring). The former is burdensome on the individual, and the latter devices are prone to failure, particularly after thousands of use cycles.

Therefore, a need exists in the art for an improved bench that automatically returns to an upright position through more effective and intriguing means. Further, a need exists in the art for aesthetically-pleasing bench that responds and/or conforms to one or more users when in the seated position.

SUMMARY OF THE DISCLOSURE

It is therefore a primary object, feature, and/or advantage of the present disclosure to improve on or overcome the deficiencies in the art.

It is another object, feature, and/or advantage of the present disclosure to provide a seating apparatus that is unique in appearance and function. The seating apparatus can include a plurality of articulating assemblies arranged in a side-by-side configuration. The plurality of articulating assemblies can incrementally articulate relative to one another between an upright position and a seated position.

It is still another object, feature, and/or advantage of the present disclosure to provide a seating apparatus that automatically returns from the seated position to the upright position. Each of the plurality of articulating assemblies can advantageously utilize a counterweight to pivot the seating apparatus. Each of the plurality of articulating assemblies can incrementally articulate relative to one another while returning to the upright position.

It is still yet another object, feature, and/or advantage of the present disclosure to utilize an advantageous linkage assembly to pivot a back member relative to a seat member when the seat member is pivoted relative to the base member (or ground member). The linkage assembly provides for a seat-like appearance of the seating apparatus in the seated position.

It is an object, feature, and/or advantage of the present disclosure to provide an articulating seating apparatus configured to articulate in two directions. The unique and advantageous design can permit an individual to sit on a seating surface positioned on one side of the back member, and another individual to sit on another seating surface positioned on another side of the back member.

These and/or other objects, features, and advantages of the present disclosure will be apparent to those skilled in the art. The present disclosure is not to be limited to or by these objects, features and advantages. No single embodiment need provide each and every object, feature, or advantage.

According to an aspect of the disclosure, a seating apparatus is provided. The seating apparatus includes an interconnected plurality of articulating assemblies having an upright position and a seated position. Each of the plurality of articulating assemblies includes a seat member pivotally connected to a base member, and a back member pivotally connected to the seat member. The plurality of articulating assemblies are interconnected in a side-by-side configuration. Further, the plurality of articulating assemblies is configured to automatically return from the seated position to the upright position.

A seating surface includes the seat members of the plurality of articulating assemblies. A first portion of the seating surface can be in the seated position when under influence of a force on the first portion of the seating surface, whereas a second portion of the seating surface can be in the upright position when the first portion is in the seated position. The articulation of more than one of the plurality of articulating assemblies can be based, at least in part, an applied force along the seating surface. The articulation of the plurality of articulating assemblies is configured to vary along the seating surface such that the seating surface can be curvilinear. Further, the plurality of articulating assemblies can be configured to articulate in two directions into a double-side configuration having two seating surfaces positioned on opposite sides of the back members of the plurality of articulating assemblies.

According to another aspect of the disclosure, the seating apparatus is comprised of an interconnected plurality of articulating assemblies. Each of the plurality of articulating assemblies includes a base member (or ground member), a seat member, and a back member. The seat member is pivotally connected to the base member proximate to a first end of the base member. The back member is pivotally connected to the seat member proximate to a first end of the seat member. A ground member can be coupled to the base member of one of the plurality of articulating assemblies and directly contacting the ground. The base member (or ground member), the seat member, and/or back member can be secured together by one or more support rods extending through the same.

Each of the plurality of articulating assemblies can includes a counterweight operably connected to the seat member proximate to a second end of the seat member. The seat member is configured to pivot from a substantially vertical position to a substantially horizontal position. Further, one or more connecting rods is configured to pivot the back member relative to the seat member when the seat member is pivoted relative to the base member.

The plurality of assemblies are configured to pivot incrementally relative to one another from the seated position to the upright position. To that end, each of the plurality of articulating assemblies cab further include a recessed area within the back member proximate to a first end of the back member, the recessed portion having a contact surface. A protrusion can extend outwardly from the seat member proximate to the first end of the seat member. The protrusion from one of the plurality of articulating assemblies extends within the recessed area from an adjacent one of the plurality of articulating assemblies.

BRIEF DESCRIPTION OF THE DRAWINGS

Illustrated embodiments of the disclosure are described in detail below with reference to the attached drawing figures, which are incorporated by reference herein, and where.

DETAILED DESCRIPTION

Figure 1A:
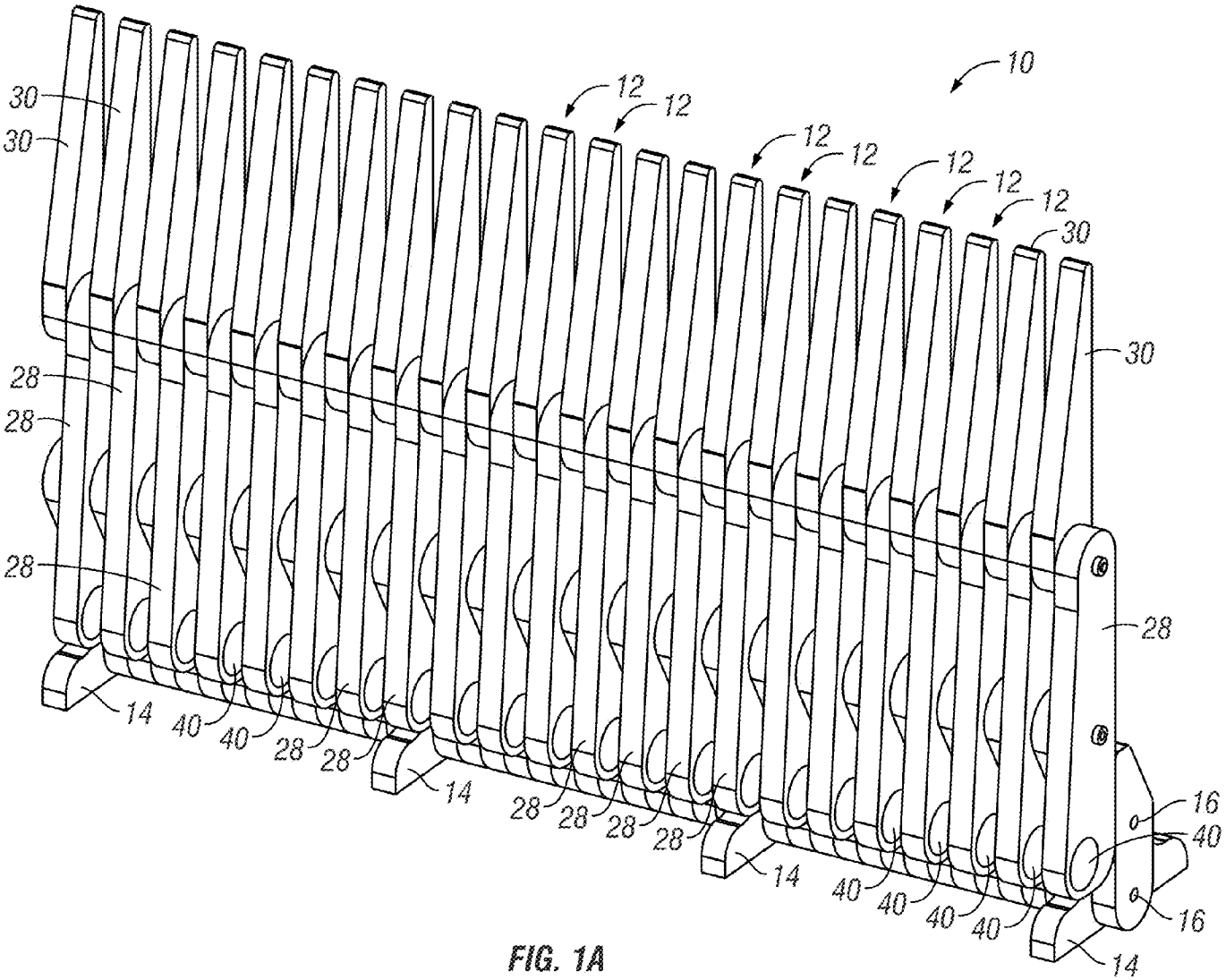
FIG. 1A is a front perspective view of a seating apparatus in accordance with an illustrative embodiment of the present disclosure.
Figure 1B:
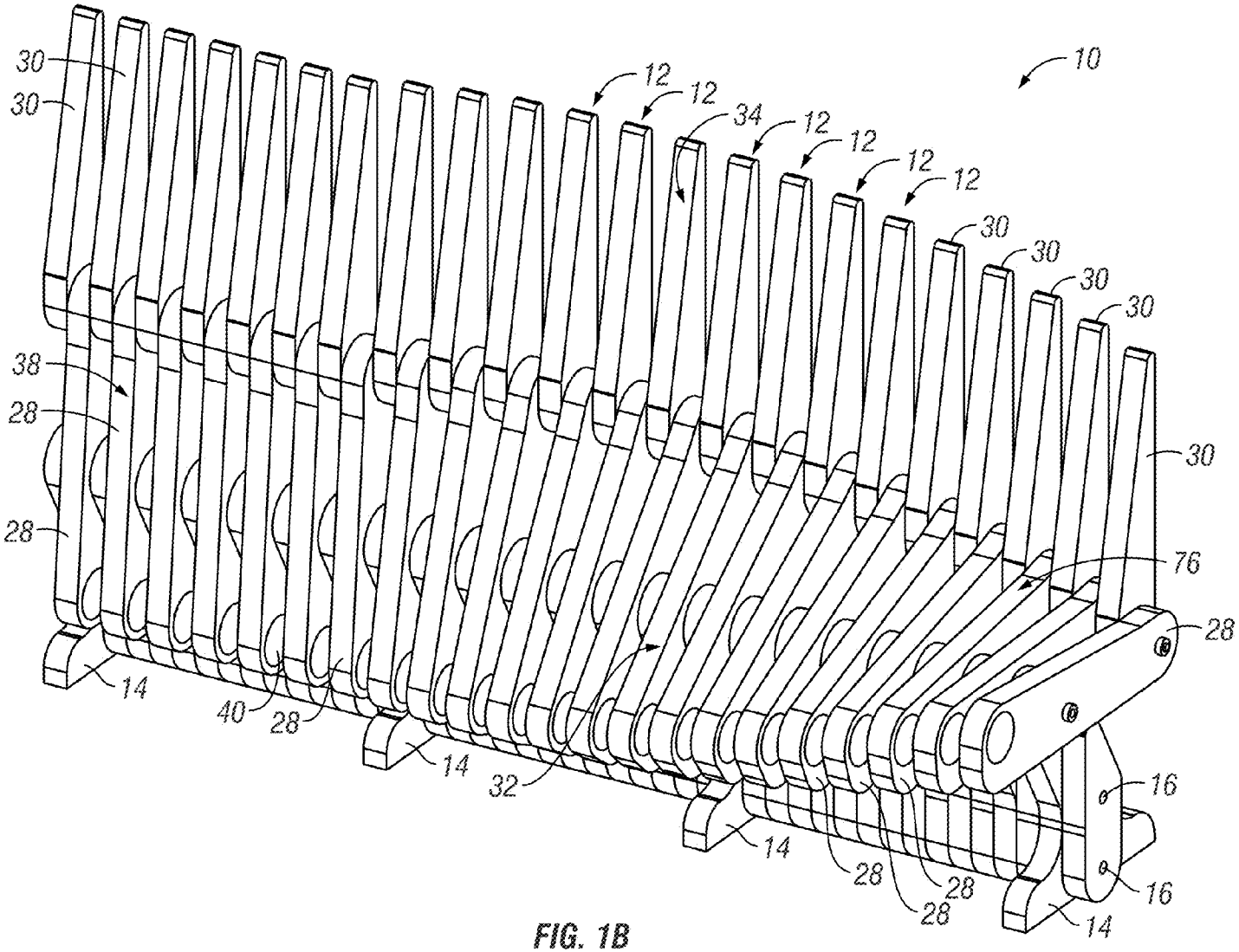
FIG. 1B is a front perspective view of a seating apparatus in accordance with an illustrative embodiment of the present disclosure.
Figure 1C:
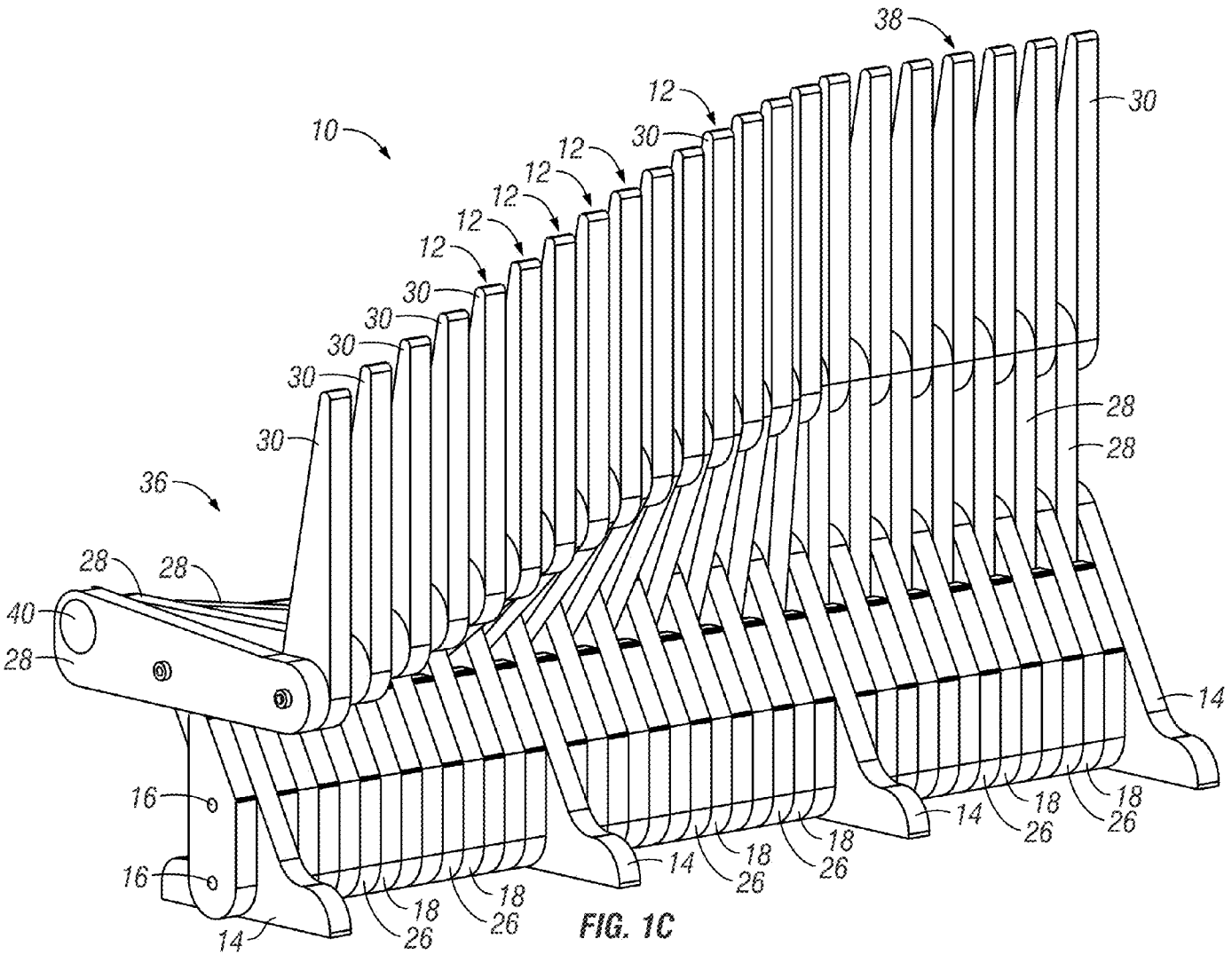
FIG. 1C is a rear perspective view of a seating apparatus in accordance with an illustrative embodiment of the present disclosure.
Figure 2:
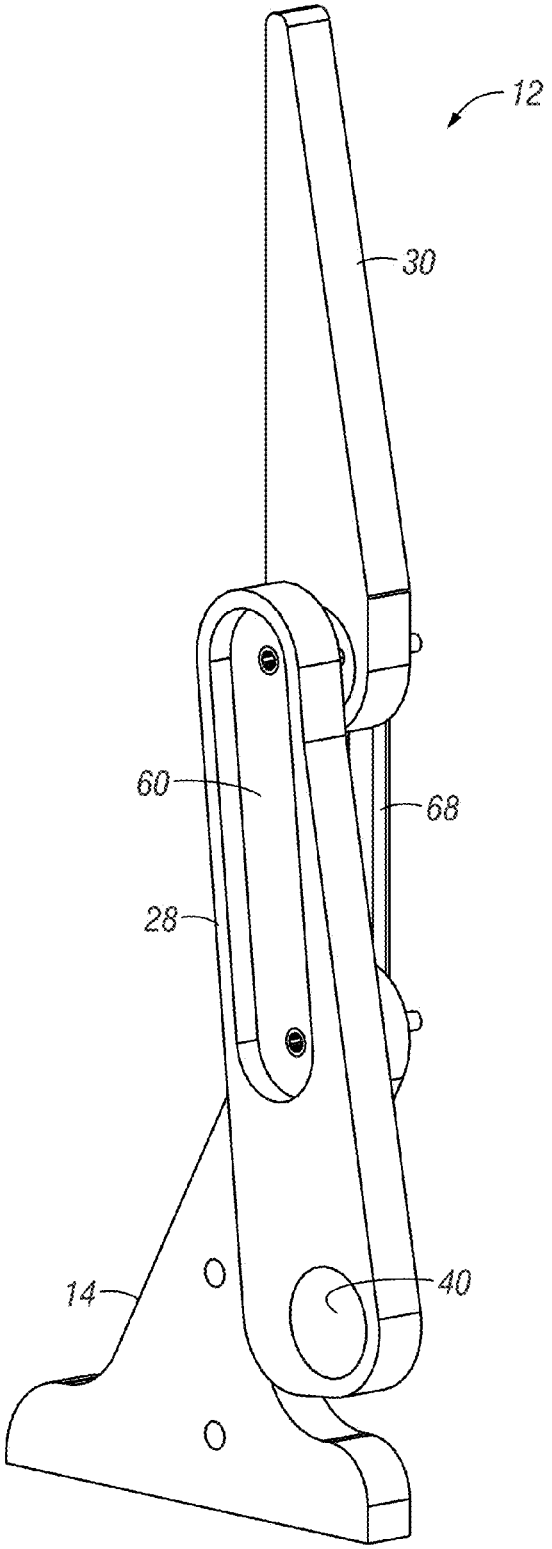
FIG. 2 is a front perspective view of an articulating assembly in accordance with an illustrative embodiment of the present disclosure.

FIGS. 1A-1C illustrate a seating apparatus 10 in accordance with an illustrative embodiment of the present disclosure. The seating apparatus 10 includes an interconnected plurality of articulating assemblies 12, one of which is illustrated in FIGS. 2A and 2B. The plurality of articulating assemblies 12 can be connected to one in a side-by-side configuration, as illustrated in FIGS. 1A-1C. The plurality of articulating assemblies 12 can have an upright position, a seated position, and any number of intermediate positions between the upright position and the seated position. The plurality of articulating assemblies 12 in an upright position is illustrated in FIG. 1A; and a portion of the plurality of articulating assemblies 12 in a seated position is illustrated in FIGS. 1B and 1C.

Figure 3A:
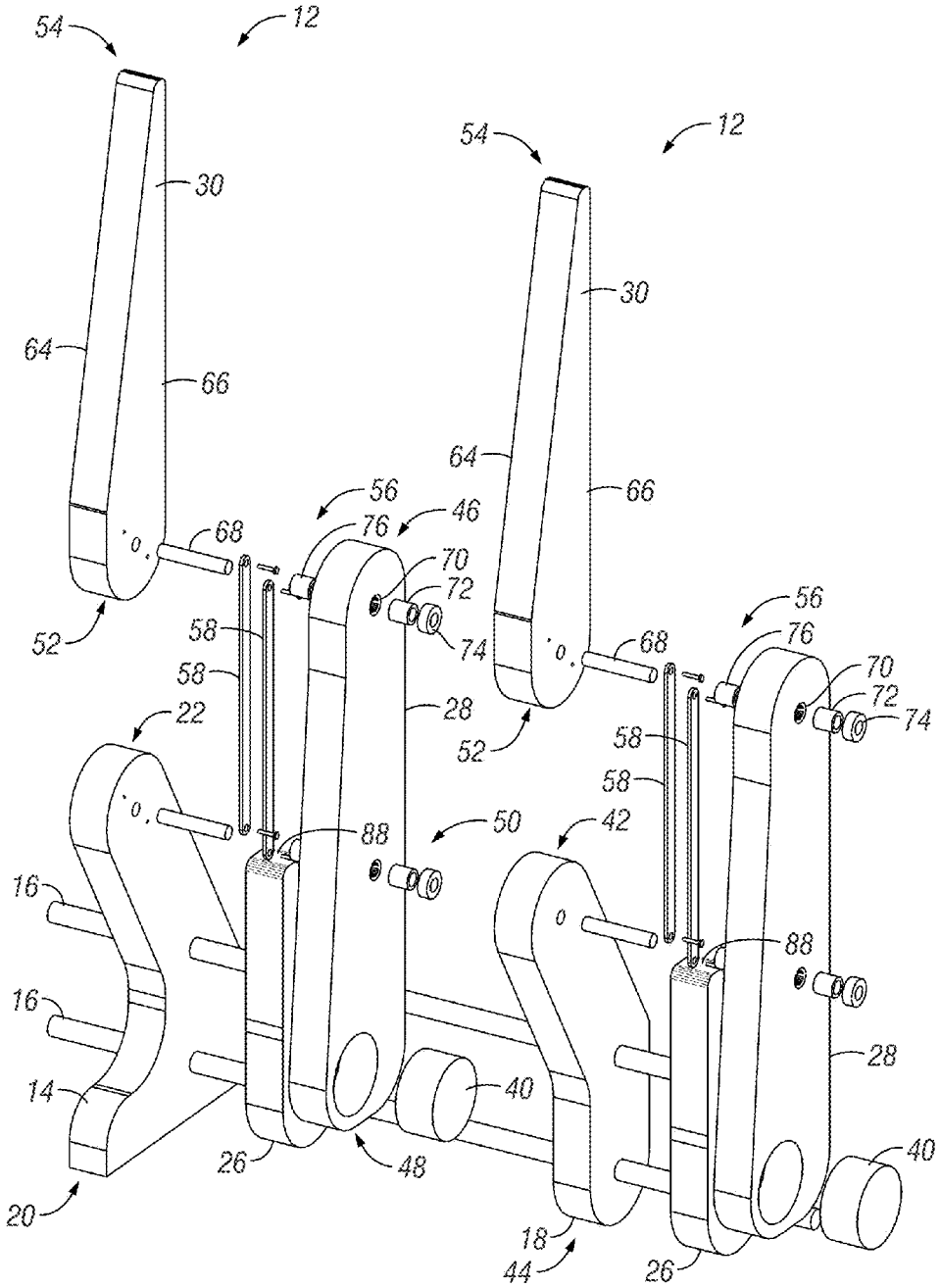
FIG. 3A is an exploded perspective view of articulating assemblies in accordance with an illustrative embodiment of the present disclosure.
Figure 3B:
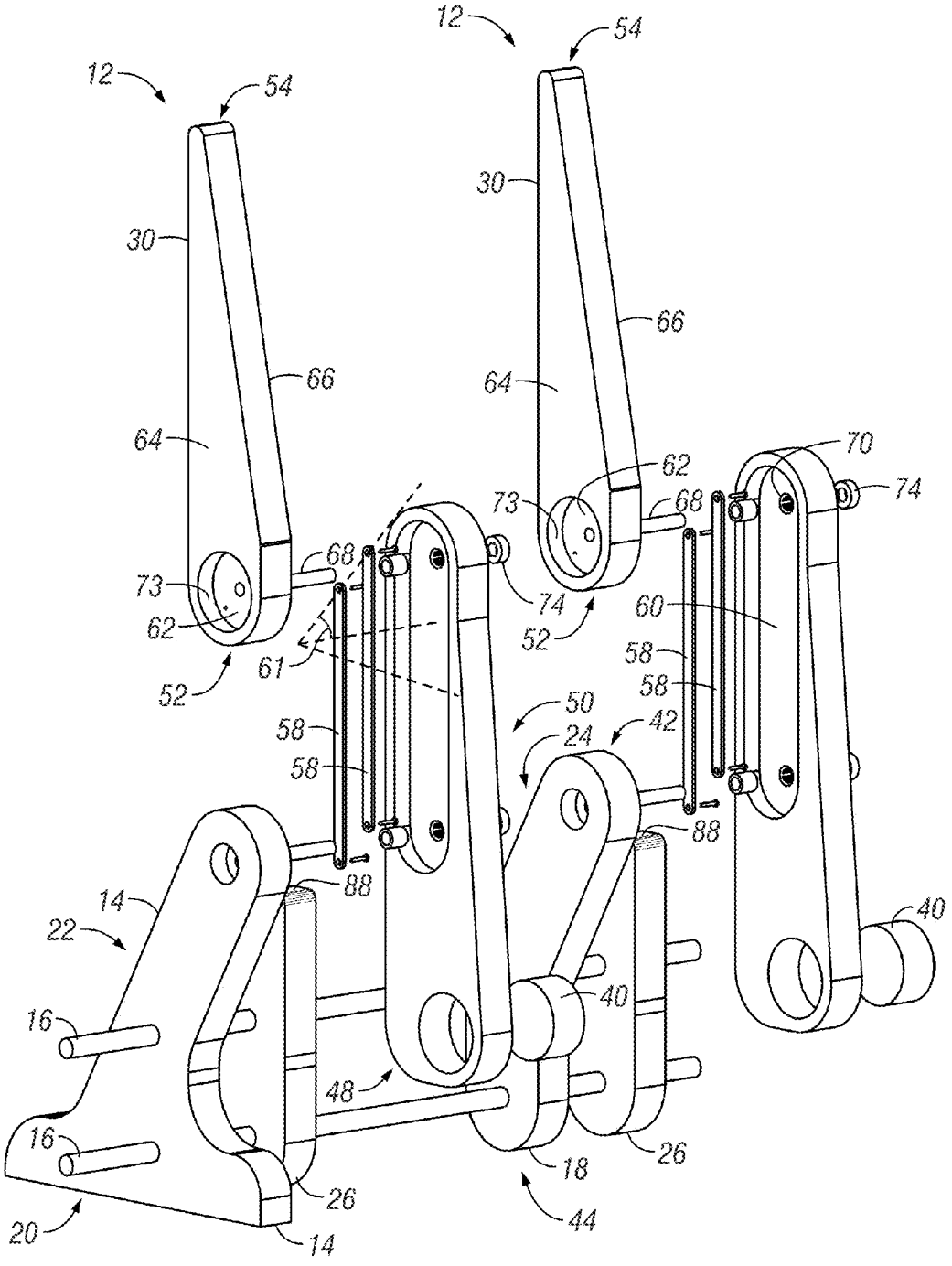
FIG. 3B is an exploded perspective view of articulating assemblies in accordance with an illustrative embodiment of the present disclosure.

Each of the plurality of articulating assemblies 12 includes one or more ground members 14 configured to rest upon a flat surface and stabilize the seating apparatus 10 in the upright, intermediate, and/or seated positions. Referring to FIG. 3B, the ground member 14 can include a leg portion 20 and a generally upstanding upright portion 22. In the exemplary embodiment illustrated in the figures, the upright portion 22 is angled upwardly and forwardly relative to the leg portion 22. The angle can be forty-five degrees, or any other suitable angle to balance and stabilize the seating apparatus 10. In other words, the other structures of the seating assembly 10 are connected to the upright portion 22 of the ground member 14 in such a manner that the central of gravity of the seating apparatus 10 is maintained in an appropriate position in the upright, intermediate, and/or seated positions. The exemplary seating apparatus 10 of FIGS. 1A-1C includes four ground members 14—two positioned proximate to the ends of the seating apparatus 10, and two positioned at an interior position along the same.

Referring to FIGS. 1A-1C and 3B, the support rods 16 can be elongated tubular members. The support rods 16 are preferably constructed of metal, but any material of sufficient strength can be incorporated without deviating from the objects of the present disclosure. In a preferred embodiment, the support rods 16 extend the length of the seating assembly 10. The support rods 16 can be secured in place on each end of the seating assembly 10 with cap nuts, but other locking means are envisioned. Further, the present disclosure contemplates the support rods 16 can extend less than the length of the seating assembly 10 so long as each of the plurality of articulating assemblies 12 is secured to two adjacent plurality of articulating assemblies 12.

A portion of the support rods 16 between two adjacent ground members 14 are subjected to bending forces caused by the weight of the seating assembly 10 and any individuals seated thereupon. The present disclosure contemplates any number of ground members 14 can be incorporated to provide sufficient support to the support rods 16. Furthermore, while the exemplary embodiment illustrated in FIGS. 1A-1C show the ground members 14 even spaced along the length of the seating assembly 10, this need not be the case. The modularity of the seating assembly 10, which will be described in detail below, provides for any or all of the plurality of articulating assemblies 12 to be associated with a ground member 14.

Each of plurality of articulating assemblies 12 can further include a base member 18. Referring to FIGS. 1C and 3B, the base member 18 is similar to the ground member 14 in several respects. First, the support rods 16 extend through the base member 18. Second, the base member 18 can include an angled portion 24 that can be sized and shaped to match the upright portion 22 of the ground member 14. In fact, other than not having a leg portion 20 of the ground member 14 to support the seating assembly 10, the base member 18 and the ground member 14 can be interchangeable.

Disposed between two ground members 14, two base members 18, and/or a ground member 14 and a base member 18 are one or more base supports 26. One or more base supports 26 can further comprise one of the plurality of articulating assemblies 12. The base supports 26, among other things, provide appropriate spacing for seat members 28 disposed between upright portions 22 of the ground members 14. Each of the base supports 26 also has a contact surface 30 configured to contact the seat member 28 in the seated position and restrict movement beyond a substantially horizontal position, as will be discussed in detail below. Based on their functional relationship, the base supports 26 will generally be positioned along the length of the seating assembly 10 in a same position as one of the seat members 28.

The ground members 14, the base members 18, and/or the base supports 26 are "sandwiched" in a side-by-side configuration along the length of the seating assembly 10, as best illustrated in FIG. 1C. The support rods 16 extend through at least a portion (but preferably all) of the ground members 14, the base members 18, and/or the base supports 26 and can serve as the structural backbone of the seating assembly 10.

Each of plurality of articulating assemblies 12 can still further the seat member 28 pivotally connected to the ground member 14 and/or the base member 16, and a back member 30 pivotally connected to the seat member 28. The seat members 28 of the plurality of articulating assemblies 12 comprises a seating surface 32 upon which an individual can sit. Similarly, the back members 30 of the plurality of articulating assemblies 12 comprises a back surface 34 that allow an individual to lean backwardly in the seating assembly 10 with support.

As illustrated in FIGS. 1B and 1C, the unique design of the seating assembly 10 provides for a portion of the seating surface 32 and back surface 34 to be in the seated position, while another portion of the seating surface 32 and back surface 34 is in the upright position. In particular, a first portion 36 of the seating surface 32 moves from the upright position to the seated position when under the influence of force on the same. A second portion 38 of the seating surface 32 can remain in the upright position when not under the influence of a force, even when the first portion 36 is in the seated position. Thus, one or more of the plurality of articulating assemblies 12 articulate based, at least in part, on an applied force along the seating surface 32. Further, the extent of articulation of the plurality of articulating assemblies 12 is configured to vary along the seating surface 32. In other words, one of the plurality of articulating assemblies 12 articulates to a greater or lesser magnitude than an adjacent one of the plurality of articulating assemblies 12. The result creates a curvilinear or wave-like seating surface 32, as illustrated in FIGS. 1B, 1C, 4 and 10. The curvilinear or wave-like configuration not only is aesthetically pleasing, but also requires only a portion of the seating assembly 10 to articulate from the upright position to the seated position under the influence of a force, which in most cases, is an individual sitting on the seating assembly 10.

Not limited to articulating into a wave-like configuration, the seating assembly is configured to automatically return to the upright position as illustrated in FIG. 1A. To that end, each of the plurality of articulating assemblies 12, and more particularly the seat member 28 of each the plurality of articulating assemblies 12, can include a counterweight 40. The counterweight 40 is configured to pivot the seat member 28 relative to the back member 30 to automatically return to return each of the plurality of articulating assemblies 12 from the seated position to the upright position. Thus, in a natural state (i.e., no individuals sitting on the seating assembly 10), the seating assembly 10 resembles the exemplary embodiment illustrated in FIG. 1A. In the illustrated embodiments disclosed herein, the counterweight is puck-shaped disposed within a cavity or hole associated with the seat members 28. However, the present disclosure contemplates any number of variations. In another exemplary embodiment, a portion of the seat member 28 can be constructed of heavier material than another portion such that the counterweight is integrally formed within the seat member 28. In still another exemplary embodiment, the counterweight can be disposed internally within the seat member 28 so as to not be visible to a user. The present disclosure contemplates the counterweight can be of sufficient mass to cause the seat member 28 to pivot relative to the back member 30. An exemplary range of mass can be two to five pounds; however, the optimal mass can be dependent on the material used to construct the seating assembly 10.

To achieve the objects of the present disclosure, the seating assembly 10 utilizes advantageous structure designs, pivot and connection points, and linkages. To that end, each base member 18 has a first end 42 and a second end 44. The first end 42 is associated with the angled portion 24 of the base member 18. The support rods 16 are operably coupled to the base member 18 proximate to the second end 44. The seat member 28 is pivotally connected to the base member 18 proximate to the first end 42 of the base member 18. The seat member 28 includes a first end 46, a second end 48, and a midpoint 50 between the first end 46 and the second end 48. The seat member 28 is configured to pivot about proximate the midpoint 50 between a substantially horizontal position and a substantially vertical position. The back member 30 includes a first end 52 and a second end 54. The first end 52 of the back member 30 is pivotally connected to the seat member 28 proximate to the first end 46 of the seat member 28. The back member 30 is configured to pivot about proximate the first end 52 and remain in a substantially vertical position. The ground member 14 can be coupled to the base member 26 and/or the seat member 28.

As each of the plurality of articulating assemblies 12 articulates from the upright position to the seated position, the back member 30 pivots relative to the seat member 28. To do so, a linkage assembly 56 operably connects the seat member 28 and the back member 30, as illustrated in FIGS. 3A and 3B. The linkage assembly 56 can include one or more connecting rods 58. The connecting rods 58 are pivotally connected proximate to the first end 46 of the back member 30 and the first end 42 of the base member 18 (and/or the ground member 14. The connecting rods 58 can be secured with screws, nails, bolts, or any other means commonly known in the art. The connecting rods 58 are configured to pivot the back member 30 relative to the seat member 28 when the seat member 28 pivots relative to the base member 26 (and/or ground member 14).

Referring to FIGS. 3A and 3B, the connecting rods 58 can be parallel to the seat member 28. Further, each of the connecting rods 58 can be parallel to one another. Still further, the points of connection of each of the connecting rods 58 can be at an angle 61 relative to the horizontal so as to impart the desired degree of relative pivoting of the seat member 28 and the back member 30. In the exemplary embodiment illustrated in FIGS. 3A and 3B, the angle 61 can be forty-five degrees. The present disclosure, however, contemplates other angles based, at least in part, on the desired relative positioning of the seat member 28 and the back member 30. For example, the angle 61 can be between thirty and sixty degrees.

The connecting rods 58 can be disposed in a recessed area 60 within the seat member 28. The recessed area 60 can be of sufficient size and shape so as to enclose the connecting rods 58. In the exemplary embodiment illustrated in FIGS. 3A and 3B, the recessed area 60 can be elongated. The recessed area 60 is designed to, among other things, house components of the seating assembly 10 such that each of the plurality of articulating assemblies 12 can be adjacent to one another without significant intervening spacing.

As previously expressed herein, the seating assembly 10 is configured to assume a curvilinear or wave-like configuration. To do so, each of the plurality of articulating assemblies 12 is configured to pivot incrementally relative to an adjacent one of the plurality of articulating assemblies 12. In other words, when one of the plurality of articulating assemblies 12 is fully articulated to the seated position, an adjacent one of the plurality of articulating assemblies 12 is articulated to a slightly lesser magnitude; and the next adjacent one of the plurality of articulating assemblies 12 is articulated to an even slightly lesser magnitude. Thus, non-seated portions of the seating surface 32, or portions of the seating surface 32 in which an individual is not seated, are pivoted incrementally less from a seated portion of the seating surface 32, or portions of the seating surface 32 in which an individual is seated.

The manner in which the incremental articulation is achieved is based on the unique and advantageous design of the seating assembly 10. A recessed coupler 62 is associated with a first side 64 of the back member 30 of each of the plurality of articulating assemblies 12, as illustrated in FIGS. 3A and 3B. Extending from a second side 66 opposite the first side 64 of the back member 30 is a coupler post 68. The coupler post 68 extends through a hole 70 proximate to the first end 46 of the seat member 28. The hole 70 can be disposed within the recessed area 60 of the seat member 28, as shown illustratively in FIGS. 3A and 3B. The interference between the coupler post 68 and the hole 70 is the primary means by which the back member 30 moves when the seat member 28 is moved, and vice versa. A first bushing 76 is operably connected on the coupler post 68 within the recessed area 60.

The length of the coupler post 68 is such that it extends through the seat member 28 and protrudes from a side opposite the recessed area 60. A second bushing 72 and a coupler ring 74 are operably connected to the coupler post 68. The coupler ring 74 from one of the plurality of articulating assemblies 12 is positioned within the recessed coupler 62 of an adjacent one of the plurality of articulating assemblies 12. More particularly, in an upright position, the coupler ring 74 from one of the plurality of articulating assemblies 12 is positioned within the center of the recessed coupler 62 of an adjacent one of the plurality of articulating assemblies 12. In the exemplary embodiment illustrated in FIGS. 3A and 3B, the coupler ring 72 and the circular recessed coupler 62 are concentric. When one of the plurality of articulating assemblies 12 is articulated from the upright position towards the seated position, the adjacent one of the plurality of articulating assemblies 12 will not articulate until the coupler ring 72 engages a contact surface 73 of the recessed coupler 62. Since the diameter (or size) of the coupler ring 72 can be less than the diameter (or size) of the recessed coupler 62, the adjacent one of the plurality of articulating assemblies 12 will not move until the difference between the two diameters is closed. After the coupler ring 72 engages the contact surface 73 of the recessed coupler 62, further articulation of the one of the plurality of articulating assemblies 12 forces the adjacent one of the plurality of articulating assemblies 12 to articulate as well. As the adjacent one of the plurality of articulating assemblies 12 begins to articulate, another adjacent one of the plurality of articulating assemblies 12 will not begin to articulate until the coupler ring 72 of the adjacent one of the plurality of articulating assemblies 12 engages the recessed coupler of the another adjacent one of the plurality of articulating assemblies 12. This iterative process continues along the length of the seating assembly 10 until all of the plurality of articulating assemblies 12 are in seated, intermediate and/or upright positions. In short, the unique tolerancing between the coupler rings 72 and the recessed couplers 62 can result in the incremental pivoting of the plurality of articulating assemblies 12.

When the applied forces are removed from at least a portion (i.e., the seated portion) of the seating surface 32, the counterweights 40 force the first end 48 of the seat member 28 downwardly, which causes the seat member 28 to pivot from the seated position towards the upright position. The pivoting of the seat member 28 forces movement of the back member 30 via the hole 70 and coupler post 68, and causes relative pivoting between the back member 30 and the seat member 28 via the linkage assembly 56. The pivoting is incremental in a reverse process are previously discussed herein. Once the seating assembly 10 is in an upright position, the seat member 28 and the back member 30 are substantially collinear, whereas the seat member 28 and the back member 30 are substantially perpendicular in the seated position.

Figure 4:
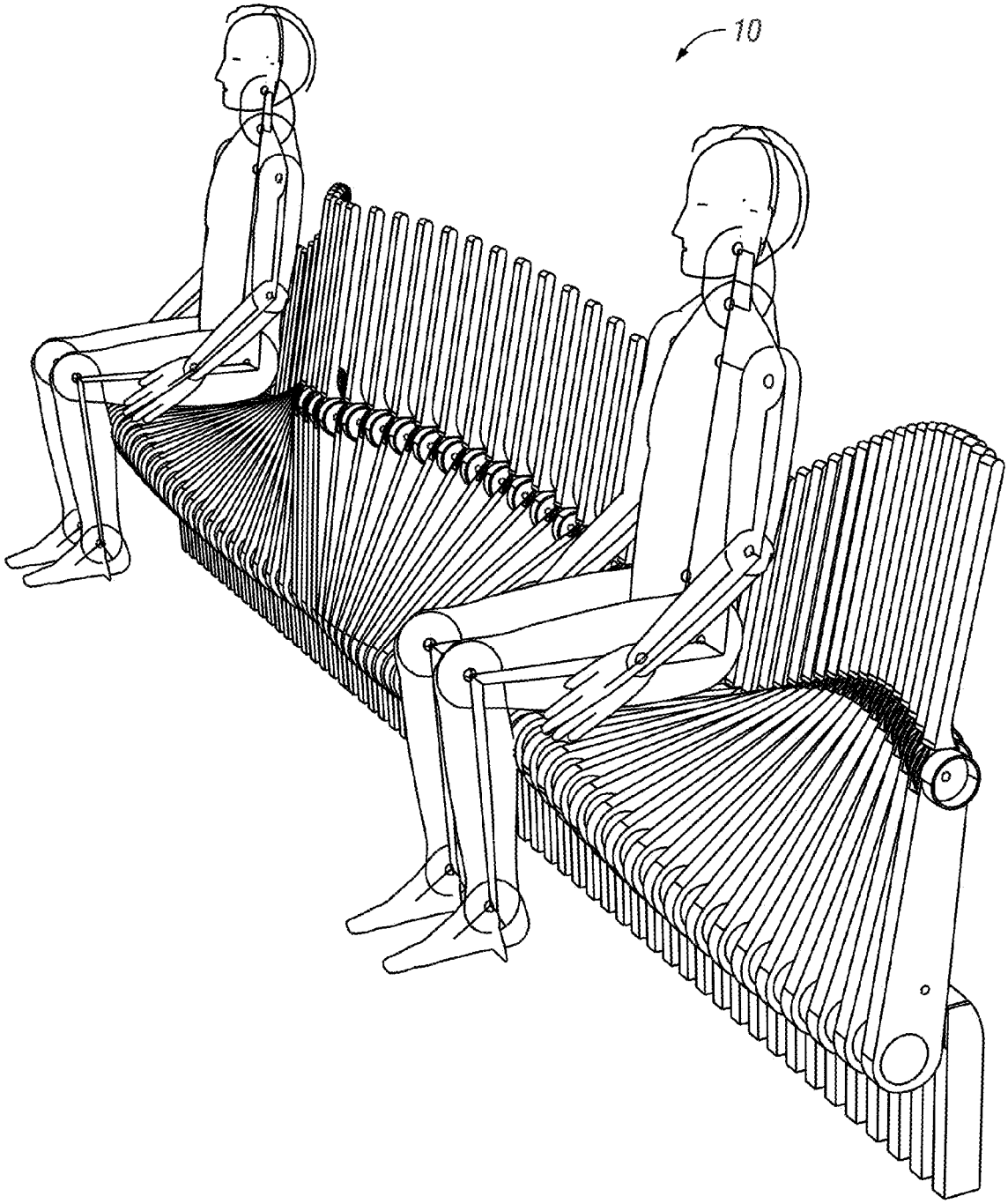
FIG. 4 is a front perspective view of a seating apparatus in accordance with an illustrative embodiment of the present disclosure.
Figure 5A:
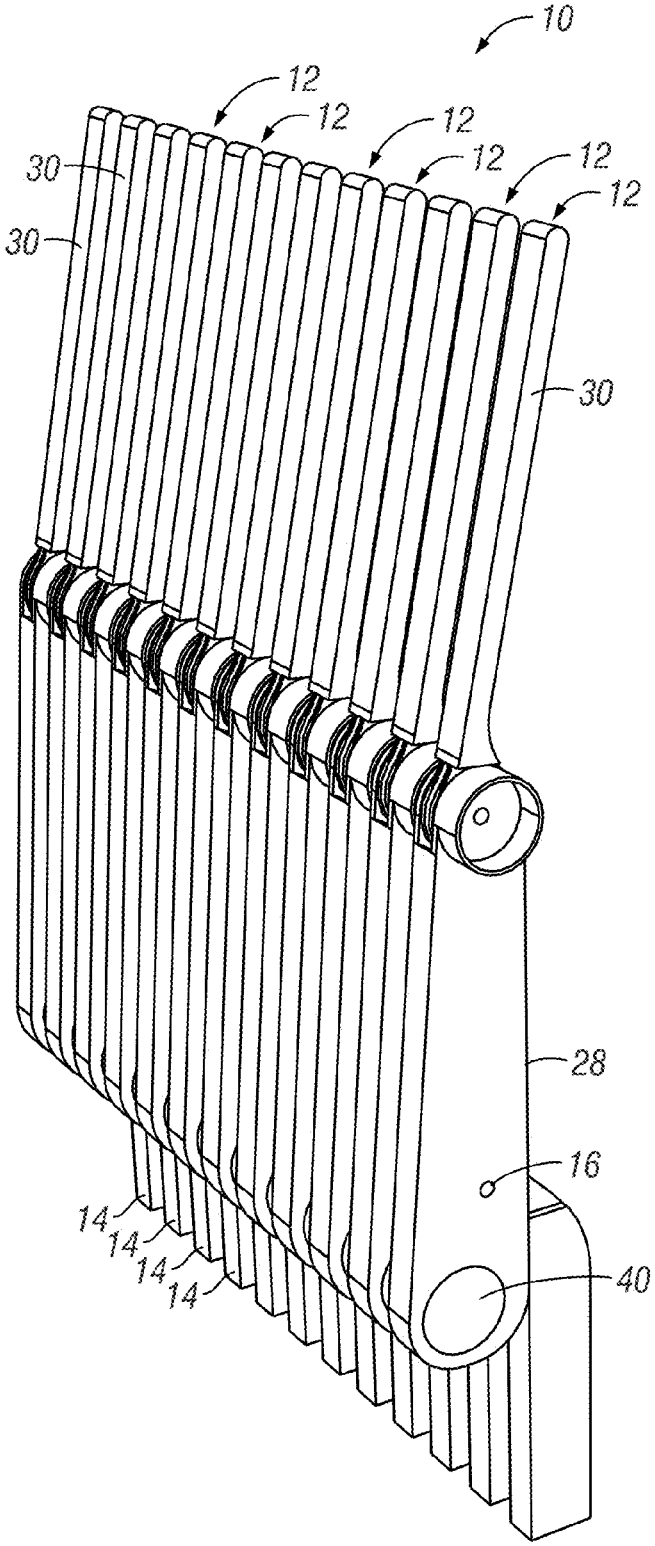
FIG. 5A is a front perspective view of a seating apparatus in accordance with an illustrative embodiment of the present disclosure.

FIG. 4 illustrates a seating apparatus 10 in accordance with another exemplary embodiment of the present disclosure. With resemblance to other exemplary embodiments, FIGS. 5A and 5B indicate that seating apparatus 10 includes a plurality of articulating assemblies 12. Each of the plurality of articulating assemblies 12 includes a back member 30 pivotally connected to a seat member 28, and the seat member 28 is pivotally connected to a ground member 14.

Figure 7A:
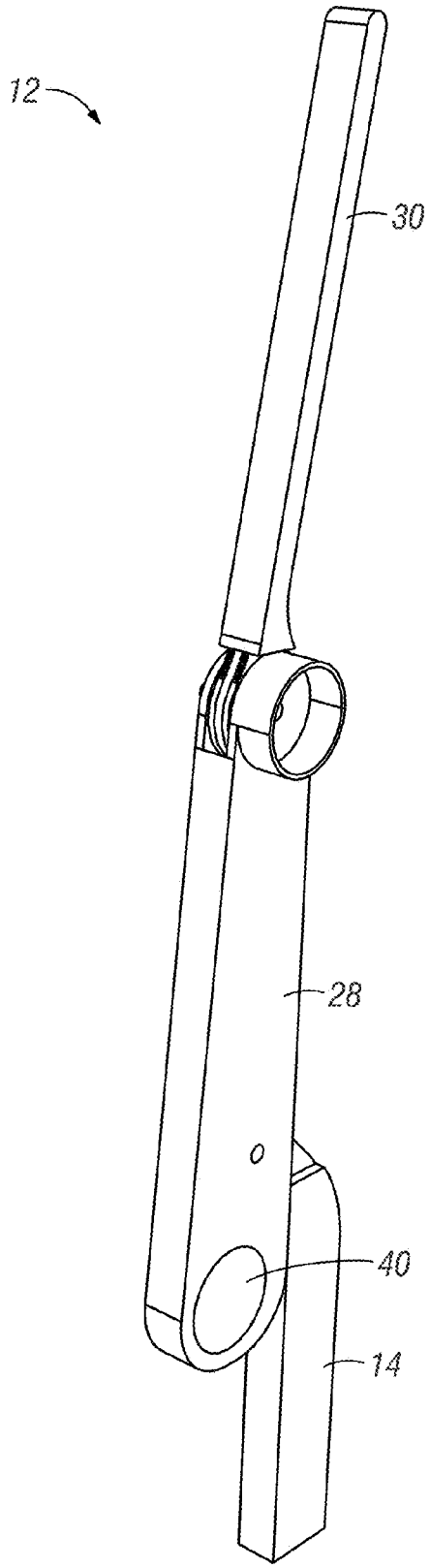
FIG. 7A is a front perspective view of an articulating assembly in accordance with an illustrative embodiment of the present disclosure.
Figure 7B:
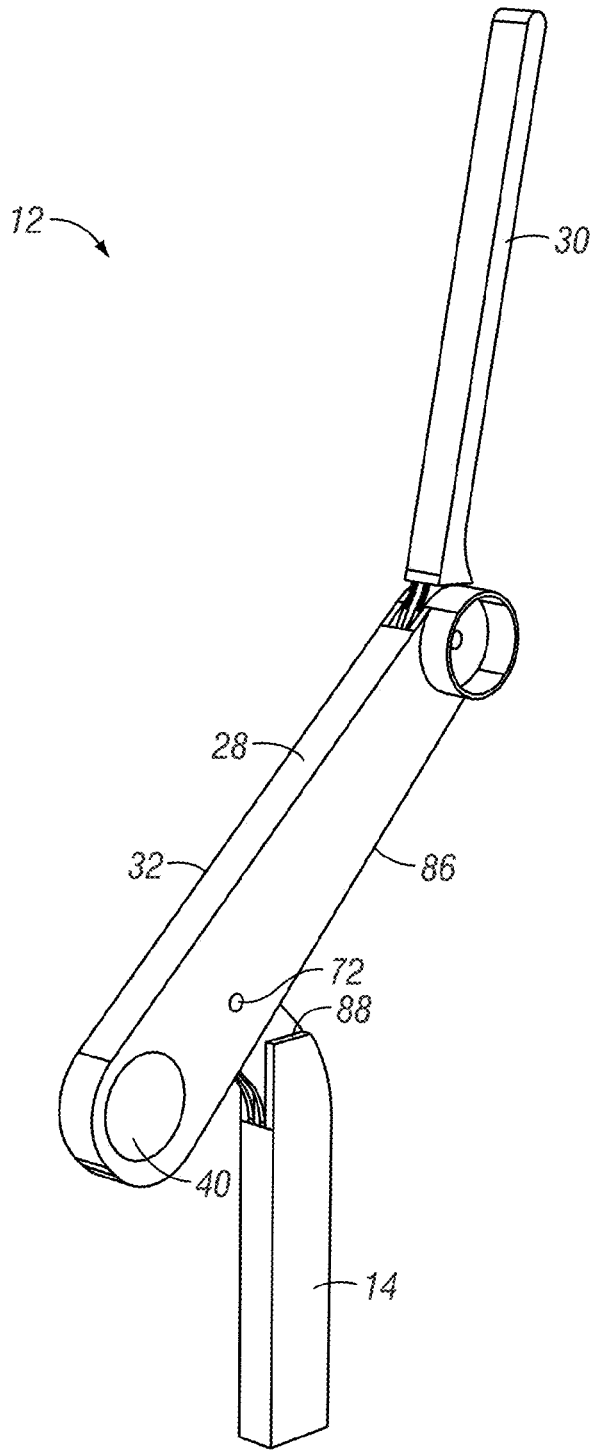
FIG. 7B is a front perspective view of an articulating assembly in accordance with an illustrative embodiment of the present disclosure.

The plurality of articulating assemblies 12 are arranged in a side-by-side configuration. A counterweight 40 is operably connected to the seat member 28 as previously expressed herein. In the illustrated embodiment of FIGS. 5A and 5B, each of plurality of articulating assemblies 12 includes a ground member 14 secured to the ground. Thus, each of the plurality of articulating assemblies 12 is independently supported such that support rods may not be necessary. Furthermore, once the seat members 28 reach the seated position, bottom surfaces contact support surfaces such that the seat member 28 is incapable of pivoting any further, as illustrated in FIGS. 7A and 7B and disclosed herein. The support surfaces terminate the articulation of each of the plurality of articulating assemblies 12. The termination occurs when the seat member 28 is in a substantially horizontal orientation. Despite some structural independence of each of the plurality of articulating assemblies 12, the plurality of articulating assemblies 12 are positioned in a proximity such that adjacent articulating assemblies are functionally and/or operably connected to one another, as will be discussed in detail herein.

Figure 6:
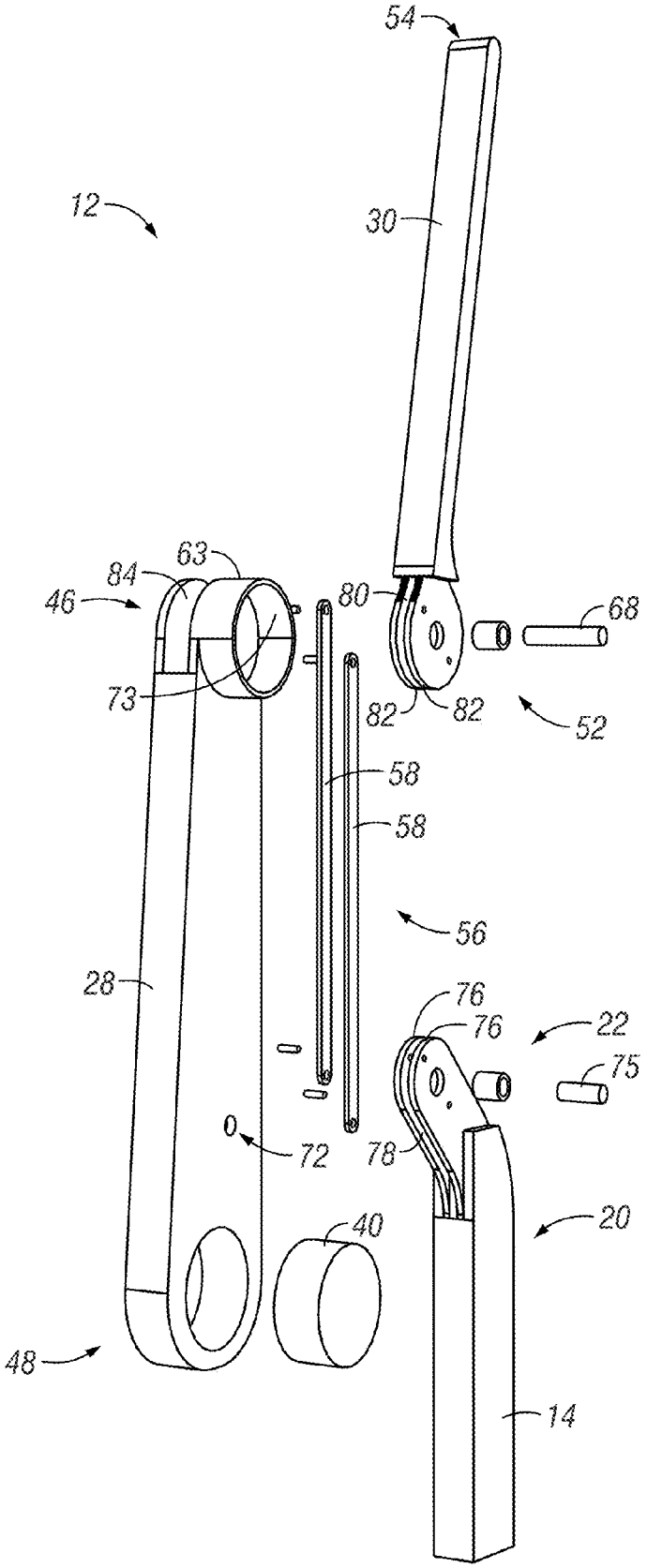
FIG. 6 is an exploded perspective view of an articulating assembly in accordance with an illustrative embodiment of the present disclosure.

Referring to FIG. 6, each of the plurality of articulating assemblies 12 includes the seat member 28 pivotally connected to the ground member 14 at a pivot point 72. The pivot point 72 associated with the seat member 28 can be positioned at any location between the first end 46 of the seat member 28 and the second end 48 of the seat member 28. In the exemplary embodiment illustrated in FIG. 6, the pivot point 72 is positioned closer to the second end 48 than the first end 46 of the seat member 28. The positioning the pivot point 72 can be based on the mass and/or position of the counterweight 40.

The seat member 28 is pivotally connected to the ground member 14 via a pin 75 engaging one or more interlocking flanges 76 associated with the ground member 14 and the pivot point 72 of the seat member 28. More particularly, the interlocking flanges 76 can be associated with the angled portion 22 of the ground member 14. FIG. 6 illustrates that the interlocking flanges 76 can be parallel plate-like structures with a gap 78 therebetween. The interlocking flanges 76 are configured to engage a slot (not shown) within the seat member 28 proximate to the pivot point 22. The pin 74 extends through the seat member 28 and the interlocking flanges 76 to permit the seat member 28 to pivot relative to the ground member 14.

With continued reference to FIG. 6, the back member 30 is pivotally connected to the seat member 28 via the coupler post 68 engaging one or more interlocking flanges 82 associated with the back member 30. More particularly, the interlocking flanges 82 can be associated with the first end 52 of the back member 30. FIG. 6 illustrates that the interlocking flanges 82 can be parallel plate-like structures with a gap 80 therebetween. The interlocking flanges 82 are configured to engage a slot 84 within the seat member 28 proximate to the first end 46 of the seat member 28. The coupler post 68 extends through the seat member 28 and the interlocking flanges 82 to permit the back member 30 to pivot relative to the seat member 28.

The back member 30 is movably connected to the ground member 14 via the linkage assembly 56. Similar to other exemplary embodiments discussed herein, the linkage assembly 56 can include one or more connecting rods 58. The connecting rods 58 are configured to pivot the back member 30 relative to the seat member 28 when the seat member 28 pivots relative to the ground member 14. The connecting rods 58 can be parallel to the seat member 28 and/or parallel to one another. The points of connection of each of the connecting rods 58 can be at an angle 62 relative to the horizontal so as to impart the desired degree of relative pivoting of the seat member 28 and the back member 30.

The connecting rods 58 are pivotally connected to the back member 30 proximate to the first end 46 of the seat member 30, and to the ground member 14 proximate to the midpoint 50 of the seat member 30. More specifically, the connecting rods 58 are pivotally connected with pins to both the interlocking flanges 82 associated with the back member 30 and the interlocking flanges 76 associated with the ground member 14. In the exemplary embodiment illustrated in FIG. 6, the connecting rods 58 are disposed within the gap 80 between the interlocking flanges 82 associated with the back member 30 and the gap 78 between the interlocking flanges 76 associated with the ground member 14. Disposing the connecting rods 58 within the gaps 78, 80 minimizes the exposure of the internal components of the articulating assemblies 12. Further, as each of the plurality of articulating assemblies 12 is independently supported, disposing the connecting rods 58 within the gaps 78, 80 results in substantial symmetry of each of the plurality of articulating assemblies 12 from the ground member 14 to the second end 54 of the back member 30. The symmetrical can reduce any side forces that could negatively impact the performance of the seating assembly 10.

The object of the present disclosure is to provide a seating assembly 10 with curvilinear seating surface and/or wave-like configuration. Each of the plurality of articulating assemblies 12 is configured to pivot incrementally relative to an adjacent one of the plurality of articulating assemblies 12. To that end, a coupler annulus 63 is operably connected to the seat member 28 proximate to the first end 46 of the same. The coupler annulus 63 can function the same as the recessed coupler 62 (see FIG. 3B) of other exemplary embodiments discussed herein. In particular, the coupler annulus 63 is configured to operably interact with the coupler post 68 extending through the interlocking flanges 82 of the back member 30.

Figure 5B:
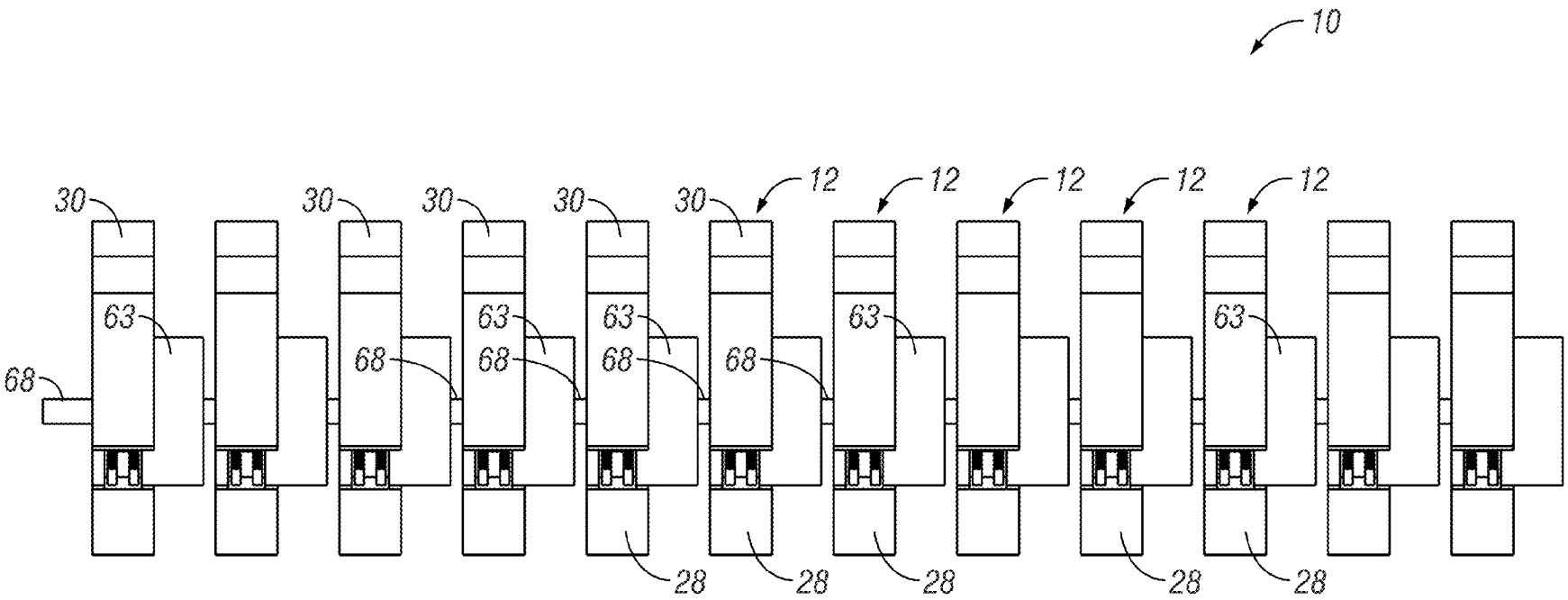
FIG. 5B is a top plan view of a seating apparatus in accordance with an illustrative embodiment of the present disclosure.

The length of the coupler post 68 is such that it protrudes from a side opposite the coupler annulus 63. The coupler post 68 from one of the plurality of articulating assemblies 12 is positioned within the coupler annulus 63 of an adjacent one of the plurality of articulating assemblies 12, as illustrated in FIG. 5B. More particularly, in an upright position, the coupler post 68 from one of the plurality of articulating assemblies 12 is positioned within the center of the coupler annulus 63 of an adjacent one of the plurality of articulating assemblies 12. When one of the plurality of articulating assemblies 12 is articulated from the upright position towards the seated position, the adjacent one of the plurality of articulating assemblies 12 will not articulate until the coupler ring 72 engages a contact surface 73 of the coupler annulus 63. After the coupler ring 72 engages the contact surface 73 of the coupler annulus 63, further articulation of the one of the plurality of articulating assemblies 12 forces the adjacent one of the plurality of articulating assemblies 12 to articulate as well. This iterative process continues along the length of the seating assembly 10 until all of the plurality of articulating assemblies 12 are in seated, intermediate and/or upright positions. In short, the unique tolerancing between the coupler posts 68 and the coupler annuli 63 can result in the incremental pivoting of the plurality of articulating assemblies 12, similar to other exemplary embodiments described herein.

Figure 7C:
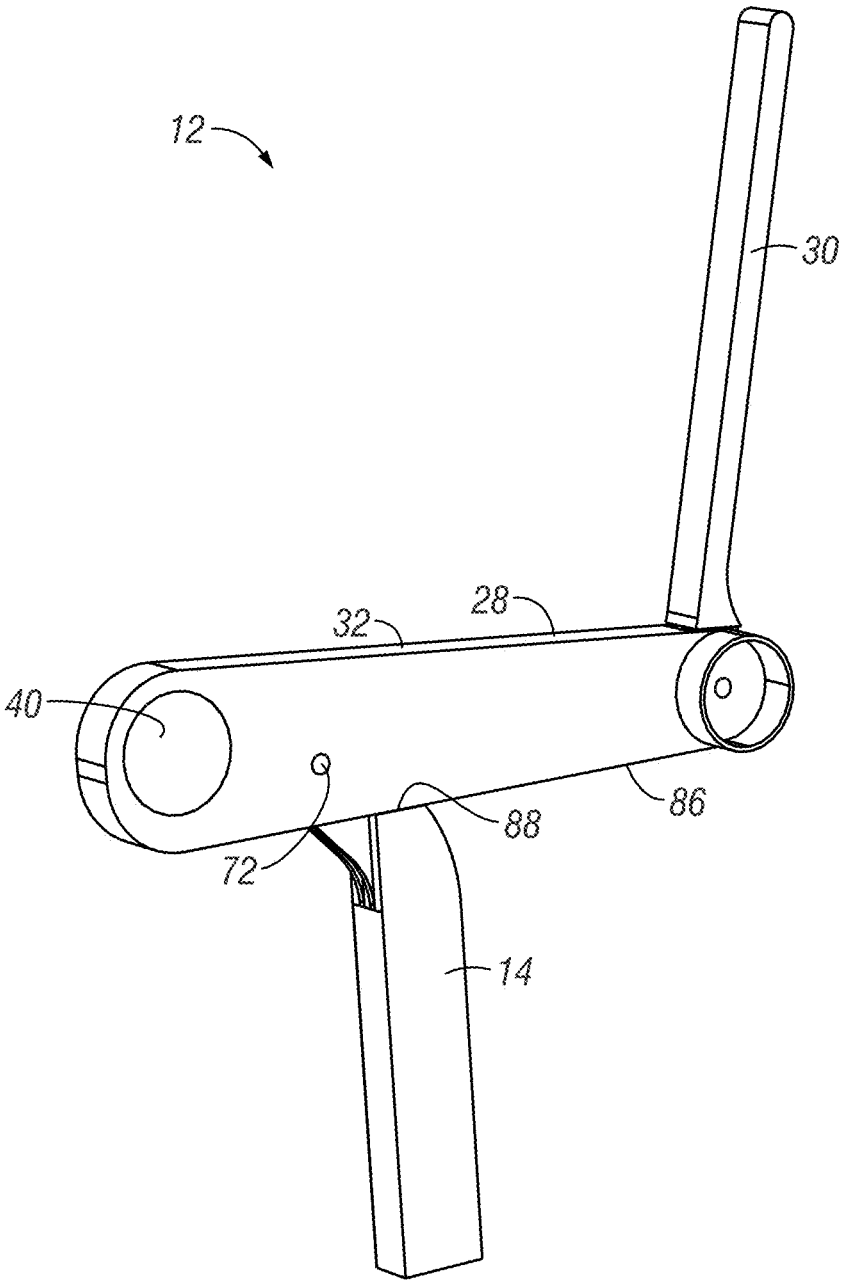
FIG. 7C is a front perspective view of an articulating assembly in accordance with an illustrative embodiment of the present disclosure.

FIGS. 7A-7C illustrate one of the plurality of articulating assemblies 12 in an upright position (FIG. 7A), intermediate position (FIG. 7B), and seated position (FIG. 7C). FIG. 7A illustrates that the back member 30 and the seat member 28 are substantially collinear in the upright position. FIG. 7C illustrates that the back member 30 and the seat member 28 are substantially perpendicular in the seated position. Further, the back member 30 and the ground member 14 are substantially parallel in the seated position, and seat member 28 and the ground member 14 are substantially perpendicular in the seated position. As the plurality of articulating assemblies 12 approaches the seated position, bottom surfaces 86 associated with the seat member 28 pivot towards support surfaces 88 associated with the ground member 14. Referring to FIGS. 7B and 7C, the support surfaces 88 can be positioned on opposite sides of the interlocking flanges 76 of the ground member 14. The bottom surfaces 86 can be positioned opposite sides of the slot (not shown) configured to receive the interlocking flanges 76 of the ground member 14. Once the seat member 28 pivots about the pivot point 72 and reaches the seated position, the bottom surfaces 86 contact with the support surfaces 88 such that the seat member 28 is incapable of pivoting any further. Therefore, the support surfaces 88 terminate the articulation of each of the plurality of articulating assemblies 12. The termination occurs when the seat member 28 is in a substantially horizontal orientation.

Similar to other exemplary embodiments described herein, when the applied forces are removed from at least a portion (i.e., the seated portion) of the seating surface 32, the process reverses. In particular, the counterweights 40 force the first end 48 of the seat member 28 downwardly, which causes the seat member 28 to pivot from the seated position towards the upright position. The pivoting of the seat member 28 causes relative pivoting between the back member 30 and the seat member 28 via the linkage assembly 56.

Figure 8:
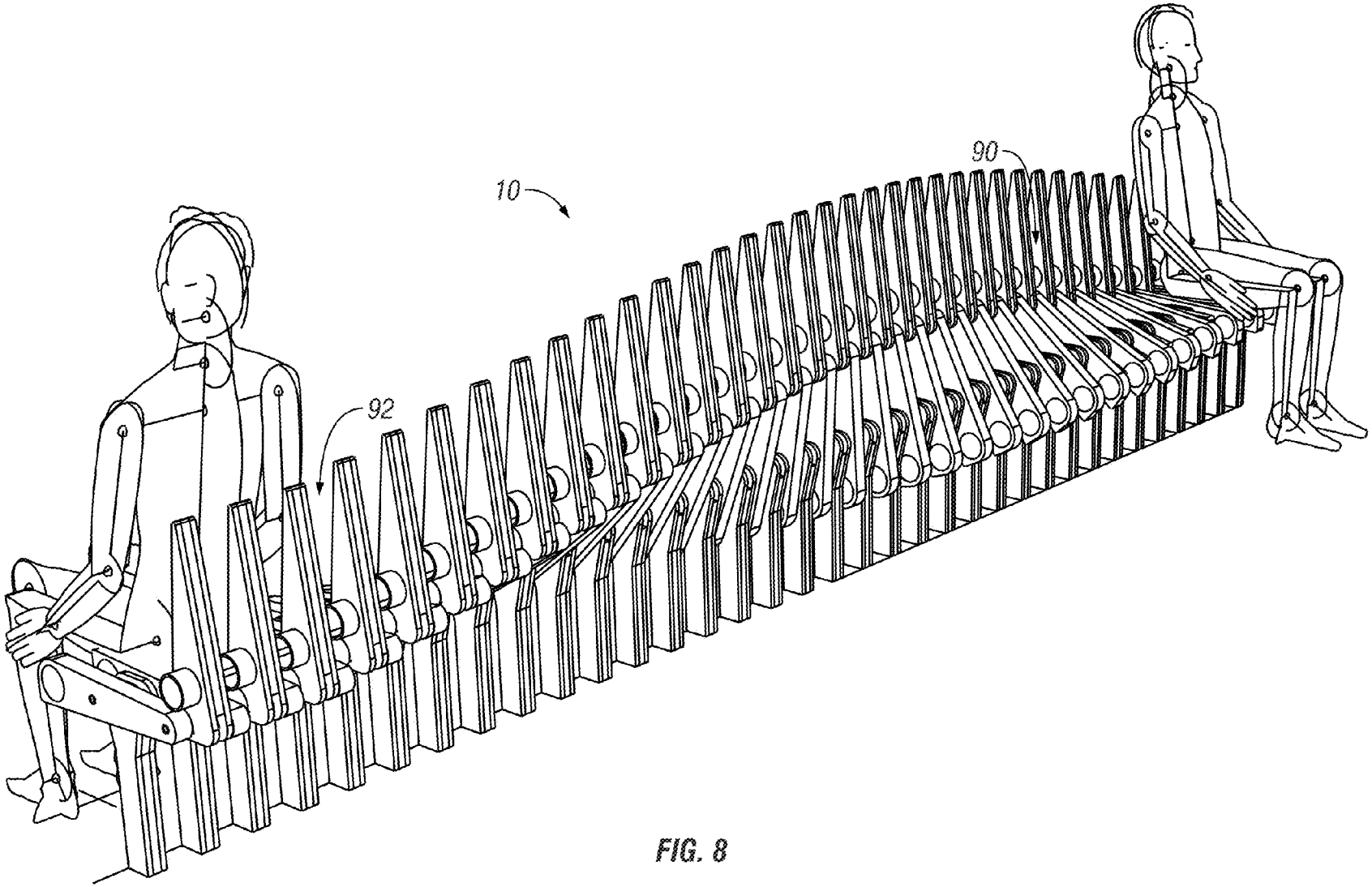
FIG. 8 is a front perspective view of a seating apparatus in accordance with an illustrative embodiment of the present disclosure.

FIG. 8 illustrates a seating apparatus 10 in accordance with another exemplary embodiment of the present disclosure. The seating apparatus 10 illustrated in FIG. 8 includes a plurality of articulating assemblies 12 configured to articulate in two directions into a double-sided configuration. The double-sided configuration includes two seating surfaces 90, 92 positioned on opposite sides of the back members 30 of the plurality of articulating assemblies 12. In other words, the double-sided configuration can include at least one back member 30 positioned between the two seating surfaces 90, 92 in the upright position and/or the seated position.

Figure 9:
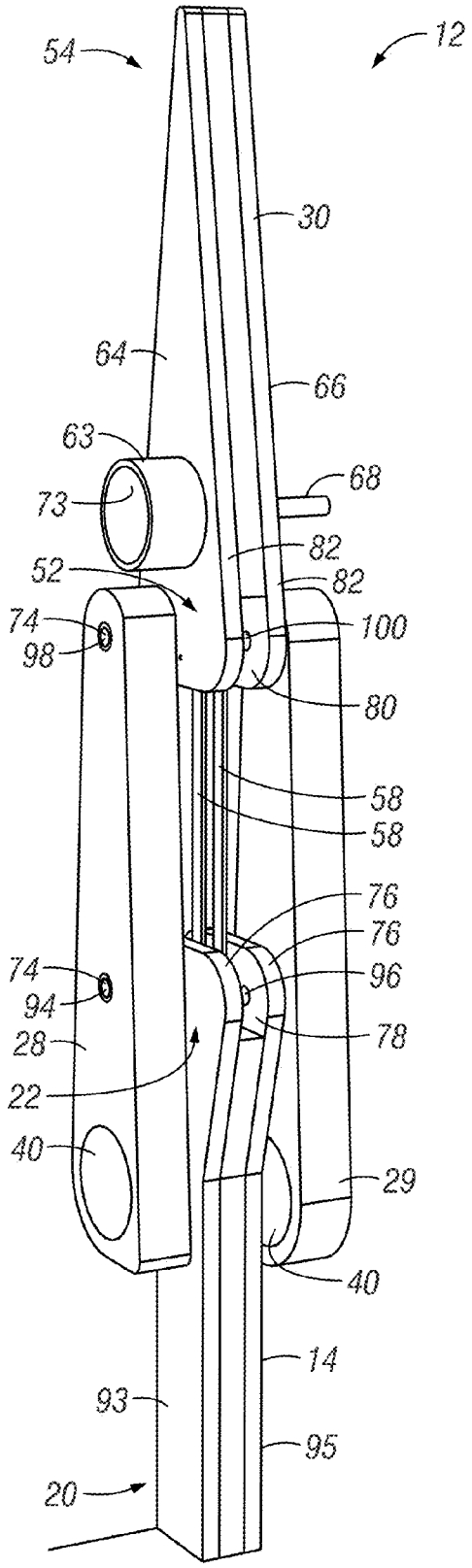
FIG. 9 is a front perspective view of an articulating assembly in accordance with an illustrative embodiment of the present disclosure.

Referring to FIG. 9, each of the plurality of articulating assemblies 12 includes a back member 30 pivotally connected to two seat members 28, 29, and the seat members 28, 29 are pivotally connected to a ground member 14. The seat members 28, 29 can be disposed on opposite sides 93, 95 of the ground member 14 and opposite sides 64, 66 of the back member 30. In other words the ground member 14 and the back member 30 can be sandwiched between the seat members 28, 29. A counterweight 40 is operably connected to each of the seat members 28, 29 as disclosed herein. Each of plurality of articulating assemblies 12 includes a ground member 14 secured to the ground. Thus, each of the plurality of articulating assemblies 12 is independently supported such that support rods may not be necessary. The plurality of articulating assemblies 12 are arranged in a side-by-side configuration and positioned in a proximity such that adjacent articulating assemblies are functionally and/or operably connected.

Each of the seat members 28, 29 are pivotally connected to the ground member 14 via pins 74 engaging one of a plurality of interlocking flanges 76 associated with the ground member 14. More particularly, the interlocking flanges 76 extend generally upwardly from the ground member 14. FIG. 9 illustrates that the interlocking flanges 76 can be parallel plate-like structures with a gap 78 therebetween. The pins 74 extend through the seat members 28, 29 and one of the plurality of the interlocking flanges 76 to permit the seat members 28, 29 to pivot relative to the ground member 14. Similarly, the back member 30 is pivotally connected to the seat members 28, 29 via pins 74 engaging a plurality of interlocking flanges 82 associated with the back member 30. The interlocking flanges 82 can be parallel plate-like structures with a gap 78 therebetween. The pins 72 extend through the seat members 28, 29 and the interlocking flanges 82 to permit the back member 30 to pivot relative to the seat members 28, 29.

The back member 30 is movably connected to the ground member 14 via the linkage assembly 56. Similar to other exemplary embodiments disclosed herein, the linkage assembly 56 can include one or more connecting rods 58. The connecting rods 58 are configured to pivot the back member 30 relative to the seat member 28 when the seat member 28 pivots relative to the ground member 14. The connecting rods 58 can be parallel to the seat member 28 and/or parallel to one another.

The connecting rods 58 are pivotally connected proximate to the first end 52 of the back member 30 and the first end 22 of the ground member 14. More specifically, the connecting rods 58 are pivotally connected with pins to both the interlocking flanges 82 associated with the back member 30 and the interlocking flanges 76 associated with the ground member 14. The connecting rods 58 can be disposed within the gap 80 between the interlocking flanges 82 associated with the back member 30 and the gap 78 between the interlocking flanges 76 associated with the ground member 14.

Each of the plurality of articulating assemblies 12 is configured to pivot incrementally relative to an adjacent one of the plurality of articulating assemblies 12. To that end, the coupler annulus 63 is operably connected to and/or extending outwardly from a first side 64 of the back member 30. In the illustrated embodiment of FIG. 9, the coupler annulus 63 is approximately as wide as the thickness of the seat member 28 so as to create a flush profile when the plurality of articulating assemblies 12 are arranged in the side-by-side configuration.

The coupler annulus 63 is configured to operably interact with the coupler post 68 extending outwardly from a second side 66 of the back member 30. As illustrated in FIG. 9, the coupler post 68 is generally positioned opposite the coupler annulus 63. In the upright position the coupler annuli 63 and the coupler posts 68 can be coaxial.

The coupler post 68 from one of the plurality of articulating assemblies 12 is positioned within the coupler annulus 63 of an adjacent one of the plurality of articulating assemblies 12. More particularly, in an upright position, the coupler post 68 from one of the plurality of articulating assemblies 12 is positioned within the center of the coupler annulus 63 of an adjacent one of the plurality of articulating assemblies 12. When one of the plurality of articulating assemblies 12 is articulated from the upright position towards the seated position, the adjacent one of the plurality of articulating assemblies 12 will not articulate until the coupler post 68 (or coupler ring 74 (see FIG. 3B)) engages a contact surface 73 of the coupler annulus 63. After the coupler post 68 engages the contact surface 73 of the coupler annulus 63, further articulation of the one of the plurality of articulating assemblies 12 forces the adjacent one of the plurality of articulating assemblies 12 to articulate as well. This iterative process continues along the length of the seating assembly 10 until all of the plurality of articulating assemblies 12 are in seated, intermediate and/or upright positions.

Figures 10A, 10B, 10C, 10D, 10E:
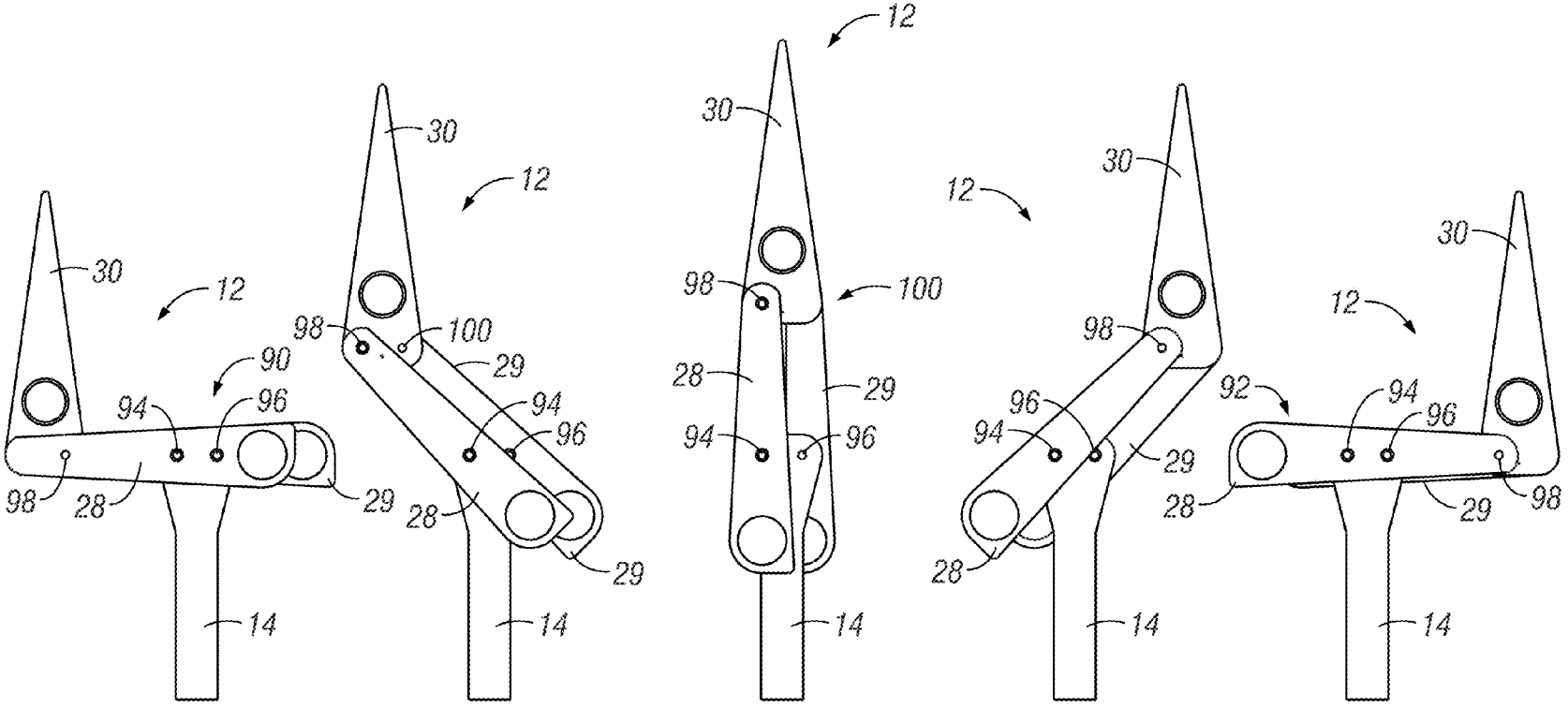
FIG. 10A is a side elevation view of an articulating assembly in a seated position in accordance with an illustrative embodiment of the present disclosure.
FIG. 10B is a side elevation view of an articulating assembly in a stage of articulation in accordance with an illustrative embodiment of the present disclosure.
FIG. 10C is a side elevation view of an articulating assembly in an upright position in accordance with an illustrative embodiment of the present disclosure.
FIG. 10D is a side elevation view of an articulating assembly in a stage of articulation in accordance with an illustrative embodiment of the present disclosure.
FIG. 10E is a side elevation view of an articulating assembly in a seated position in accordance with an illustrative embodiment of the present disclosure.

An object of the exemplary embodiment illustrated in FIGS. 8-10 is to articulate in two directions so as to create two seating surfaces 90, 92. To that end, each of the seat members 28, 29 includes pivot points 94, 96 that are horizontally aligned but vertically offset. Similarly, the back member 30 includes pivot points 98, 100 that are horizontally aligned but vertically offset. One of the seat members 28 extends between pivot points 94, 98, and another one of the seat members 29 extends between separate pivot points 96, 100. The configuration results in an articulating assembly 12 as illustrated in Sector C of FIG. 10. The configuration also results in a vertical line of symmetry when the articulating assembly 12 is in the upright position.

Referring to Sectors B and D of FIG. 10, an articulating assembly 12 is illustrated in intermediate positions. FIG. 10 shows, among other things, that when the articulating assemblies 12 of the exemplary embodiment articulate, one of the seat members 28 extends forwardly to a greater distance than another one of the seat members 29 relative to the ground member 14. The staggering of the seat members 28, 29 of the seating surface(s) 90, 92 is based, at least in part, on the offset nature of the pivot points 94, 96, 98, 100. The staggering of the seat members 28, 29 in the seated position is illustrated in Sections A and E of FIG. 10.

Similar to other exemplary embodiments disclosed herein, when the applied forces are removed from at least a portion (i.e., the seated portion) of the seating surface(s) 90, 92, the counterweights 40 pivot the seat members 28, 29 from the seated position towards the upright position. The pivoting of the seat member 28 causes relative pivoting between the back member 30 and the seat members 28, 29 via the linkage assembly 56.

The unique and advantageous design can result in a seating apparatus 10 illustrated in FIG. 8. The seating apparatus 10 permits an individual to sit on a seating surface 90 positioned on one side of the back members 30, and another individual to sit on another seating surface 92 positioned on another side of the back members 30. Between the two seating surfaces 90, 92 in the seated position, a portion of the seating assembly 10 extends through the upright position. Based on the incremental pivoting of the plurality of articulating assemblies 12, the non-seated portion of seating assembly 10 in the upright position can generally be midway between the two seated portions in the seated position.

The present disclosure contemplates that the exemplary embodiments disclosed herein can be utilized in a variety of applications. The seating apparatus 10 can be used indoors or outdoors. For example, the seating apparatus 10 can be incorporated into a porch-setting. In such instances, the individual may wish for a more decorative finish. To that end, the ground members 14, seat members 28 and/or back members 30 can be constructed from a desired wood such as oak, maple, pine, redwood, mahogany, cherry, walnut, rosewood, teak, ash, hickory, beech, birch, cedar, redwood, hemlock, fir, spruce, and the like. Further, the back members 30 can be designed with artistic flare, particularly proximate to the second end 54 of the back members 30. While a generally triangular-shape is illustrated in, for example, FIG. 10, any number of designs can be incorporated. For another example, municipalities or other entities may incorporate the seating apparatus 10 into a setting such as bus stops, parks, playgrounds, and the like. In such instances, more robust materials may be desired. The ground members 14, seat members 28 and/or back members 30 can be constructed from plastics such as polyolefins (e.g., high density polyethylene (HDPE), low density polyethylene (LDPE), polypropylene (PP)), polyvinyl chlorides (PVC), and fluropolymers (e.g., polyethylene terephthalate (PETE), fluorinated ethylene propylene (FEP), PerFluoroAlkoxy (PFA), polyvinylidene fluoride (PVDF), ethylene tetrafluoroethylene (ETFE), etc.). The ground members 14, seat members 28 and/or back members 30 can be constructed from metals (e.g., steel, alumnimum, brass, tin, etc.) fabricated from any number of means, including but not limited to casting, milling, forging, forming, cutting, welding, and the like. The wood(s), plastic(s) and/or metal(s) can be treated to be weather resistant, chemical resistant, corrosion resistant, and the like.

The disclosure is not to be limited to the particular embodiments described herein. In particular, the disclosure contemplates numerous variations in the type of seating apparatus that incrementally articulate from an upright position to a seated position and/or automatically return from the seated position to the upright position. The foregoing description has been presented for purposes of illustration and description. It is not intended to be an exhaustive list or limit any of the disclosure to the precise forms disclosed. It is contemplated that other alternatives or exemplary aspects that are considered included in the disclosure. The description is merely examples of embodiments, processes or methods of the disclosure. It is understood that any other modifications, substitutions, and/or additions can be made, which are within the intended spirit and scope of the disclosure. For the foregoing, it can be seen that the disclosure accomplishes at least all that is intended.

The previous detailed description is of a small number of embodiments for implementing the disclosure and is not intended to be limiting in scope. The following claims set forth a number of the embodiments of the disclosure with greater particularity.

What is claimed is:

1. A seating apparatus comprising:

a plurality of articulating assemblies, each of the articulating assemblies having an upright position and a seated position, each of the articulating assemblies having:

a base member;

a seat member pivotally connected to the base member;

a back member pivotally connected to the seat member; and a linkage connecting the back member to the base member whereby pivotal movement of the set member relative to the base member causes pivotal movement of the back member relative to the seat member; and a plurality of coupling mechanisms interconnecting the articulating assemblies within the plurality of articulating assemblies, whereby each articulating assembly within the plurality of articulating assemblies is connected to an adjacent articulating assembly within the plurality of articulating assemblies by a coupling mechanism, each coupling mechanism having:

a coupler post extending laterally from a first articulating assembly towards a second articulating assembly adjacent to the first articulating assembly;

a coupler recess within the second articulating assembly that receives the coupler post, the coupler recess having a contact surface that is larger than the coupler post such that the coupler post is offset from the contact surface when the first and second articulating assemblies are in their upright positions, and whereby movement of the first articulating assembly is transmitted to cause movement of the second articulating assembly by the coupler post pushing against the contract surface and whereby movement of the first articulating assembly away from the upright position is not transmitted to the second articulating assembly until the coupler post moves into contact with the contact surface of the coupler recess.

2. The seating apparatus of claim 1 wherein the plurality of articulating assemblies is interconnected in a side-by-side configuration.

3. The seating apparatus of Maim 1 further comprising:

a seating surface comprising the seat members of the plurality of articulating assemblies; and a first portion of the seating surface in the seated position when under influence of a force on the first portion of the seating surface.

4. The seating apparatus of claim 3 further comprising a second portion of the seating surface in the upright position when the first portion is in the seated position.

5. The seating apparatus of claim 1 further comprising:

a seating surface comprising the seat members of the plurality of articulating assemblies; and wherein articulation of more than one of the plurality of articulating assemblies is based, at least in part, an applied force along the seating surface.

6. The seating apparatus of claim 5 wherein the articulation of the plurality of articulating assemblies is configured to vary along the seating surface.

7. The seating apparatus of claim 1 wherein one of the plurality of articulating assemblies articulates to a greater or lesser magnitude than an adjacent one of the plurality of articulating assemblies.

8. The seating apparatus of claim 1 further comprising:

a seating surface comprising the seat portions of the plurality of articulating assemblies; and wherein the seating surface is configured to be curvilinear.

9. The seating apparatus of claim 1 wherein the plurality of articulating assemblies is configured to automatically return from the seated position to the upright position.

10. The seating apparatus of claim 9 wherein each of the plurality of articulating assemblies further includes a counterweight disposed on the seat member and configured to pivot the seat member relative to the back portion to automatically return said articulating assembly from the seated position to the upright position.

11. The seating apparatus of claim 1 wherein the linkages each comprise:

connecting rods operatively connected to the seat member and the back member; and wherein the connecting rods are configured to pivot the back member relative to the seat member in the seated position and the upright position.

12. The seating apparatus of claim 1 wherein the plurality of articulating assemblies is configured to articulate in two directions into a double-side configuration having two seating surfaces positioned on opposite sides of the back members of the plurality of articulating assemblies.

13. The seating apparatus of claim 12 wherein the double-side configuration further includes at least one back member positioned between the two seating surfaces in the upright position.

14. A seating apparatus comprising:

an plurality of articulating assemblies, each of the articulating assemblies in the plurality includes:

(a) a base member having a first end and a second end;

(b) a seat member pivotally connected to the base member proximate to the first end of the base member, the seat member having a first end, a second end, and a midpoint between the first end and the second end; and (c) a back member having a first end and a second end, wherein the first end of the back member is pivotally connected to the seat member proximate to the first end of the seat member; and a plurality of coupling mechanisms interconnecting the articulating assemblies, whereby each articulating assembly is connected to an adjacent articulating assembly of the plurality of articulating assemblies by a coupling mechanism, each coupling mechanism having:

a coupler member extending laterally from a first articulating assembly towards a second articulating assembly adjacent to the first articulating assembly;

a coupler recess within the second articulating assembly that receives the coupler member, the coupler recess having a contact surface that is larger than the copular member such that there is a space between the coupler member and the contact surface when the first and second articulating assemblies are in their upright positions, and whereby movement of the first articulating assembly is transmitted to cause movement of the second articulating assembly by the coupler member pushing against the contract surface and whereby movement of the one articulating assembly away from the upright position is not transmitted to the articulating assembly adjacent to the one articulating assembly until the coupler member moves across the space into contact with the contact surface of the coupler recess, whereby the plurality of articulating assemblies incrementally pivot relative to each other.

15. The seating apparatus of claim 14 further comprising a ground member coupled to the base member of one of the plurality of articulating assemblies and directly contacting the pound.

16. The seating apparatus of claim 15 further comprising one or more support rods extending through and rigidly securing the wound member and the base members of the plurality of articulating assemblies.

17. The seating apparatus of claim 14 wherein the seat member pivots about a point proximate the midpoint.

18. The seating apparatus of claim 14 wherein each of the plurality of articulating assemblies further includes a counterweight operably connected to the seat member proximate to the second end of the seat member.

19. The seating apparatus of claim 14 wherein the seat member is configured to pivot from a substantially vertical position to a substantially horizontal position.

20. The seating apparatus of claim 14 wherein each of the plurality of articulating assemblies further includes:

one or more connecting rods pivotally connected proximate to the first end of the seat member and the first end of the base member; and wherein the one or more connecting rods is configured to pivot the back member relative to the seat member when the seat member is pivoted relative to the base member.

21. The seating apparatus of claim 20 where the one or more connecting rods are parallel to the seat member.

22. The seating apparatus of claim 20 wherein the one or more connecting rods are disposed within an elongated recessed area within the seat member.

23. The seating apparatus of claim 14 wherein the back member and the seat member are substantially collinear in the upright position and substantially perpendicular in the seated position.

24. A seating apparatus comprising:

a plurality of assemblies interconnected in a side-by-side configuration, wherein the plurality of assemblies are configured to articulate from an upright position to a seated position to partially conform to a user sitting on a seated portion of the seating apparatus, wherein each of the plurality of assemblies further comprises a base member, a seat member pivotally connected to the base member, and a back member pivotally connected to the seat member, wherein the back member pivots relative to the seat member when the seat member is pivoted relative to the base member; and a plurality of coupling mechanisms interconnecting the assemblies, wherein each assembly is connected to an adjacent assembly by one of the coupling mechanisms, wherein there is a gap in each coupling mechanism when the assemblies are in the upright position, and wherein initial movement of one assembly is not transmitted to an assembly adjacent to the one assembly until the gap is closed in the coupling mechanism between adjacent assemblies whereby portions of the seating apparatus are pivoted incrementally from the upright position to the seated position, wherein each coupling mechanism comprises: a coupler member extending laterally from one assembly towards a second assembly adjacent to the first assembly; a coupler recess within the second assembly that receives the coupler member, the coupler recess having a contact surface that is larger than the coupler member to form the gap between the coupler member and the contact surface when the first and second assemblies are in their upright positions, and whereby movement of the first assembly is transmitted to cause movement of the second assembly by the coupler member pushing against the contract surface and whereby movement of the first assembly away from the upright position is not transmitted to the second assembly adjacent until the coupler member moves across the gap into contact with the contact surface of the coupler recess.

25. The seating apparatus of claim 24 wherein the base members of the plurality of assemblies comprise a seating surface, wherein incremental pivoting of the plurality of assemblies from the seated position to the upright position creates a curvilinear seating surface.

26. The seating apparatus of claim 24 wherein the plurality of assemblies is configured to articulate in two directions into a double-side configuration having the seating surface and a second seating surface positioned on opposite sides of the back portions of the plurality of assemblies.

* * * * *